US008640596B1

(12) United States Patent
Canaday et al.

(10) Patent No.: US 8,640,596 B1
(45) Date of Patent: Feb. 4, 2014

(54) GAS EXTRACTION SYSTEM RETROFIT KIT FOR GUN WEAPON SYSTEM

(75) Inventors: Michael M. Canaday, King George, VA (US); Jeffrey M. Pardee, King George, VA (US); Andrew C. Smith, King George, VA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 216 days.

(21) Appl. No.: 13/199,962

(22) Filed: Sep. 7, 2011

(51) Int. Cl.
*F41H 7/03* (2006.01)

(52) U.S. Cl.
USPC ..... 89/36.13

(58) Field of Classification Search
USPC ..... 89/36.13, 36.14, 36.08
See application file for complete search history.

(56) References Cited

U.S. PATENT DOCUMENTS

| | | | | |
|---|---|---|---|---|
| 4,016,398 | A | 4/1977 | Herrick | 42/25 |
| 4,069,607 | A | 1/1978 | Jurek | 219/136 |
| 5,861,569 | A * | 1/1999 | Abels | 89/36.08 |
| 7,021,189 | B2 * | 4/2006 | Patry et al. | 89/45 |
| 7,515,413 | B1 * | 4/2009 | Curtis | 361/695 |

* cited by examiner

*Primary Examiner* — Stephen M Johnson
(74) *Attorney, Agent, or Firm* — Gerhard W. Thielman Esq.

(57) ABSTRACT

A retrofit kit for exhausting gases is provided for removing combustion products from a gun turret. In some embodiments, the combustion products are toxic gases that include ammonia, hydrogen cyanide, and carbon monoxide. The retrofit kit includes a fan and an EMI filter. The fan and the EMI filter are attached to the gun turret with one or more seals that provide both environmental and EMI/RFI protection. In operation, the fan is activated in response to the firing of the gun, and is powered using the power supply provided to the gun turret. In some embodiments, the fan operates for a predetermined time interval after the last operation of the gun.

6 Claims, 2 Drawing Sheets

GAS EXTRACTION SYSTEM RETROFIT KIT FOR GUN WEAPON SYSTEM

STATEMENT OF GOVERNMENT INTEREST

The invention described herein was made in the performance of official duties by one or more employees of the Department of the Navy, and the invention herein may be manufactured, practiced, used, and/or licensed by or for the Government of the United States of America without the payment of any royalties thereon or therefor.

BACKGROUND OF THE INVENTION

The invention relates to ventilation systems in general and particularly to a ventilation system that removes poisonous gas components from an enclosed space.

As a result of firing rounds, toxic gases generated as combustion products, including ammonia ($NH_3$), hydrogen cyanide (HCN), and carbon monoxide (CO), build up inside the turret of the MK-46 Gun Weapon System and EX 50 Gun Mission Module Space. The presence of toxic gases is hazardous to personnel, and restricts their ability to reload and perform gun operations or to perform maintenance during and after firing events.

Currently, clearing of toxic gases from a turret is accomplished by over pressurizing the space, using high airflow to attain a high air exchange rate. This has not been very fast or effective at clearing toxic gases.

There is a need for a toxic gas extraction system that can clear toxic gases in a shorter time.

SUMMARY OF THE INVENTION

A primary objective of the present invention is to provide a kit useful in conjunction with a gun turret and a gun, the kit when installed and operated being effective in reducing a concentration of a gas in the interior of the gun turret.

It is also a primary objective of the present invention to provide a method for reducing a concentration of a gas of interest in the interior of a gun turret.

According to one aspect, the invention features a retrofit kit for application in conjunction with a gun turret and a gun that fires rounds. The retrofit kit comprises a fan configured to exhaust a quantity of air from an interior of the gun turret; an EMI filter configured to attenuate electromagnetic signals that would otherwise pass between the interior and an outside of the gun turret through the fan; and one or more mounting elements configured to provide mounting points that mate with predefined mounting positions on the gun turret, and that are configured to support the fan and the EMI filter.

In one embodiment, the retrofit kit further comprises an EMI/RFI gasket. In another embodiment, the fan has a capacity of hundreds of cubic feet per minute. According to another aspect, the invention relates to a method of reducing a concentration of a gas of interest in a gun turret. The method comprises the steps of installing the components of a retrofit kit on the gun turret and in response to a firing of a gun housed in the gun turret, and when the gas of interest is present, operating the fan to exhaust air from an interior of the gun turret, thereby reducing the concentration of the gas of interest.

The retrofit kit comprises a fan configured to exhaust a quantity of air from an interior of the gun turret; an EMI filter configured to attenuate electromagnetic signals that would otherwise pass between the interior and an outside of the gun turret through the fan; and one or more mounting elements configured to provide mounting points that mate with predefined mounting positions on the gun turret, and that are configured to support the fan and the EMI filter.

In one embodiment, the gas of interest is a combustion product of the firing of the gun. In yet another embodiment, the gas of interest is a toxic gas. In another embodiment, the toxic gas is a gas selected from the group consisting of ammonia, hydrogen cyanide, and carbon monoxide. In still another embodiment, the fan is caused to operate under control of a control circuit. In a further embodiment, the fan is caused to operate for a predetermined period of time. In yet a further embodiment, the predetermined period of time is five minutes. The foregoing and other objects, aspects, features, and advantages of the invention will become more apparent from the following description and from the claims.

BRIEF DESCRIPTION OF THE DRAWINGS

The objects and features of the invention can be better understood with reference to the drawings described below, and the claims. The drawings are not necessarily to scale, emphasis instead generally being placed upon illustrating the principles of the invention. In the drawings, like numerals are used to indicate like parts throughout the various views.

DETAILED DESCRIPTION

The purpose of the gas extraction kit is to remove toxic gases, including ammonia ($NH_3$), hydrogen cyanide (HCN), and carbon monoxide (CO), which gases are created by firing 30 mm rounds from a MK-46 turret, in order to allow the operator to safely and effectively perform mission critical operations during both training and combat firing events. Operationally, clearing these gases allows the turret to be manned locally during casualty operations, and allows entry into the turret space quickly after firing evolutions for maintenance and reload evolutions.

An advantage provided by using this system in a MK-46 turret includes greatly reduced toxic gas levels in the turret in shorter time as compared to presently used ventilation systems. It also more quickly clears gases after a firing event as compared to presently used ventilation systems.

Construction

Figure 1:
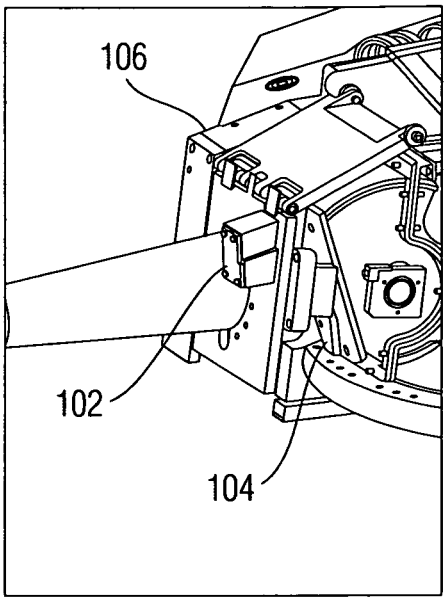
FIG. 1 is a perspective view of a portion of a MK-46 turret, illustrating where an exemplary embodiment attaches to the turret.
Figure 2:
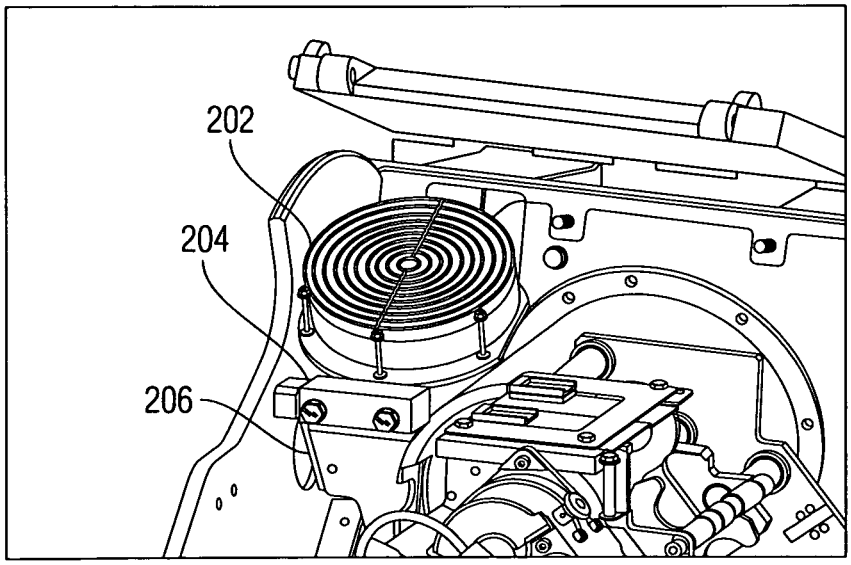
FIG. 2 is a perspective view of some of the exemplary parts as mounted to a portion of the MK-46 turret as seen from the inside.
Figure 3:
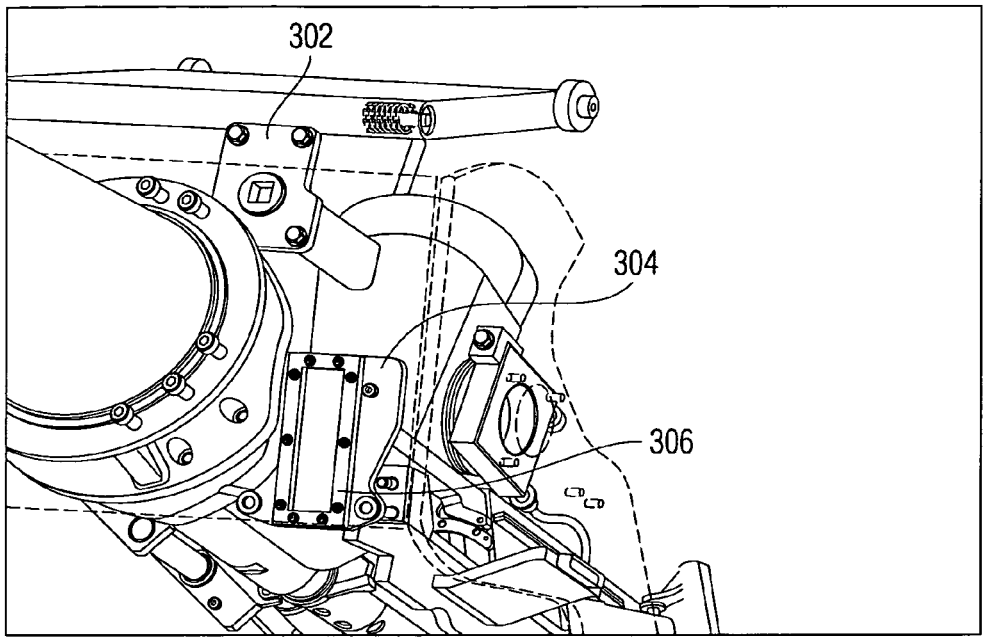
FIG. 3 is a perspective view of some of the exemplary parts as mounted inside a portion of the MK-46 turret as seen from the outside in a frontal view.
Figure 4:
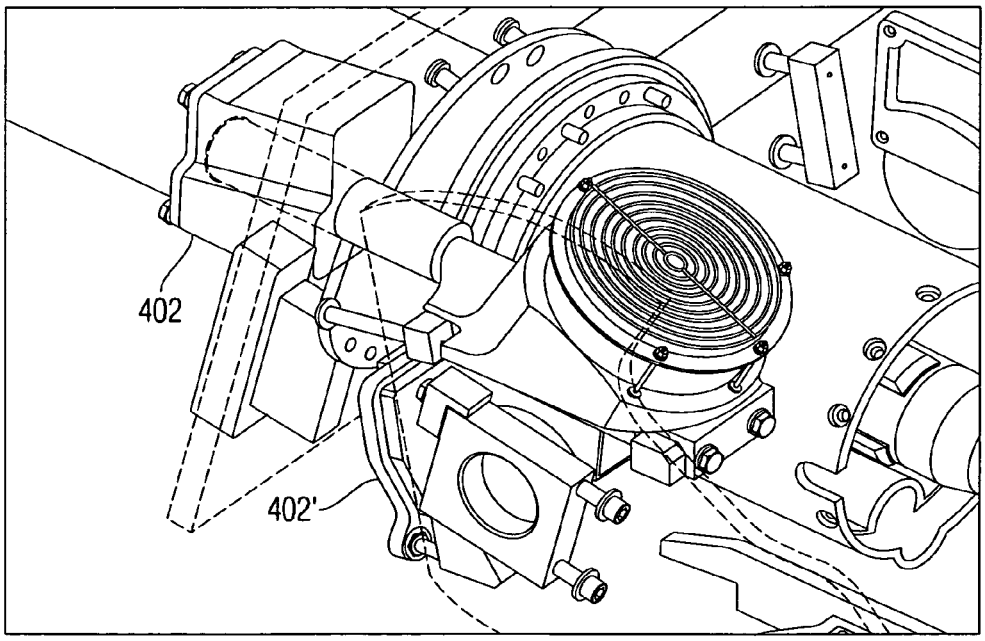
FIG. 4 is a perspective view of the exemplary EMI parts as mounted inside a portion of the MK-46 turret as seen from the outside in a side view.

As illustrated in FIG. 1, the gas extraction kit is installed into a MK-46 turret by removing the coax gun cover plates 102 and 104 and their associated hardware, and installing parts as shown in FIGS. 2, 3 and 4 in their place. The MK-46 turret 106 houses the gun that fires 30 mm rounds. The gas extraction kit includes a fan and an EMI filter that provides EMI/RFI shielding. The EMI filter is configured to attenuate electromagnetic signals that would otherwise pass between the inside and the outside of the gun turret through the fan (or the opening through which the fan exhausts the toxic gases). To those of ordinary skill in the electromagnetic arts, the EMI/RFI filter is a Faraday shield.

As shown in FIG. 2, a fan 202 is installed on a fan bracket 204. In operation, the fan 202 pulls air out of the interior space in the turret 106. In some embodiments, the fan 202 is a 432 cubic foot per minute (CFM) capacity fan with a finger guard (which guard is shown as a metal wire screen in FIG. 2). The fan bracket 204 uses the existing bolts and mounting locations on the coax gun casing chute cover plate support arm of the MK-46 turret. The fan side plate 206 seals a gap inherent to the gun mount and directs the air to the outside atmosphere through the casing eject chute. As described hereinbelow, the fan side plate 206 also attaches to the EMI screen frame 304 illustrated in FIG. 3.

FIG. 3 illustrates additional parts that comprise the invention. A front bracket 302 attaches by bolts to the front of the fan bracket 204 and uses the existing bolts (e.g., mounting elements) and location of the coax gun blank plate 102 at the plate's through-holes corresponding to the mounting points. The fan 202 exhausts air through the EMI filter 306, which also provides EMI/EMV shielding. In some embodiments, the EMI filter 306 is a Spira™ Spira-cell aluminum honeycomb filter, available from Spira Manufacturing Corporation, 12721 Saticoy Street South, North Hollywood, Calif. 91605. An EMI screen frame 304 provides mounting points for the EMI filter 306. The EMI screen frame 304 in turn mounts to the turret 106 and the fan side plate 206.

FIG. 4 is a perspective view of the EMI parts that comprise the invention. The gaskets 402, 402' are MAJR Multicon oriented aluminum wire sponge silicone sealing material available from MAJR Products Corporation, 17540 State Highway 198, Saegertown, Pa. 16433. The gaskets 402 and 402' provide both an environmental seal and EMI/RFI shielding over the locations corresponding to their respective cover plates 102 and 104. MAJR Products Corporation describes Multicon EMI gasketing material as a combination of silicone and conductive paths to provide an environmental seal as well as electromagnetic and radio frequency interference shielding. The conductive wires are dispersed throughout the width of the material to provide protection against electromagnetic and radio frequency contamination. The gasketing material is constructed in such a way that when pressure is applied to the gasket, hundreds of sharp wire ends become exposed making electrical contact with the surfaces to be shielded.

Operation

The fan 202 is powered and controlled through the MK-50 Gun Mission Module's (GMM) Gun Module Remote Control System (GMRCS). The GMRCS houses the fan's power supply and turns the fan 202 on when the firing circuit is closed and when the turret is powered on. In one embodiment, when GMRCS senses an opening of the firing circuit, it initiates a software timer to power the fan 202 for five minutes. The five minute time was derived from toxic gas level decay during testing. In other embodiments, a sensor that is responsive to a specific toxic gas can be used to monitor the concentration of that gas in the MK-46 turret and to cause the fan to operate when the gas concentration is above a predetermined threshold value.

As is known in the electronic control arts, the operation of the fan can be controlled using a microprocessor-based control circuit that when operating acts in accordance with instructions recorded on a machine-readable medium.

Theoretical Discussion

Although the theoretical description given herein is thought to be correct, the operation of the devices described and claimed herein does not depend upon the accuracy or validity of the theoretical description. That is, later theoretical developments that may explain the observed results on a basis different from the theory presented herein will not detract from the inventions described herein.

The distance that a gas particle (such as a molecule of oxygen $O_2$, nitrogen $N_2$ or the toxic gases ammonia ($NH_3$), hydrogen cyanide (HCN), and carbon monoxide (CO)) can move before colliding with another gas particle is termed the "mean free path."

The formula $l=(n\sigma)^{-1}$ holds for a particle with a high velocity relative to the velocities of an ensemble of identical particles with random locations, where l is the mean free path, n is the number of target particles per unit volume, and σ is the effective cross sectional area for collision.

However, if the velocities of the identical particles have a Maxwell distribution (which is the normal circumstance in the atmosphere), then the mean free path l is given by $$l = \frac{1}{n\sigma\sqrt{2}}.$$

This is equivalent to $$l = \frac{k_B T}{\pi d^2 p\sqrt{2}},$$

where $k_B$ is the Boltzmann constant, T is temperature, d is the diameter of the gas particles, and p is pressure.

As may be seen, mean free path is expected to go as the inverse of the pressure. In the situation where one attempts to flush out toxic gases by raising the pressure, the mean free path will be reduced, and the time for the gas to diffuse will increase. However, if the pressure is reduced (for example by exhausting gases with a fan that extracts gas such as air) the mean free path will increase and the time to diffuse the toxic gases so that they can be exhausted will be expected to decrease.

Any patent, patent application, or publication identified in the specification is hereby incorporated by reference herein in its entirety. Any material, or portion thereof, that is said to be incorporated by reference herein, but which conflicts with existing definitions, statements, or other disclosure material explicitly set forth herein is only incorporated to the extent that no conflict arises between that incorporated material and the present disclosure material. In the event of a conflict, the conflict is to be resolved in favor of the present disclosure as the preferred disclosure.

It will be understood that many additional changes in the details, materials, steps and arrangement of parts, which have been herein described and illustrated in order to explain the nature of the invention, may be made by those skilled in the art within the principle and scope of the invention as expressed in the appended claims.

What is claimed is:

1. A method of reducing a concentration of a gas of interest in a gun turret, comprising the steps of:

installing the components of a retrofit kit on said gun turret, the retrofit kit comprising:

a fan configured to exhaust a quantity of air from an interior of said gun turret;

an EMI filter configured to attenuate electromagnetic signals that would otherwise pass between said interior and an outside of said gun turret through said fan; and a plurality of mounting elements configured to provide mounting points that mate with predefined mounting positions on said gun turret, and that are configured to support said fan and said EMI filter; and operating said fan to exhaust air from an interior of said gun turret in response to a firing of a gun housed in said gun turret, thereby reducing said concentration of said gas of interest.

2. The method of reducing a concentration of a gas of interest in the gun turret of claim 1, wherein said gas of interest is a combustion product of said firing of said gun.

3. The method of reducing a concentration of a gas of interest in the gun turret of claim 1, wherein said gas of interest is a toxic gas.

4. The method of reducing a concentration of a gas of interest in the gun turret of claim 3, wherein said toxic gas is a gas selected from the group consisting of ammonia, hydrogen cyanide, and carbon monoxide.

5. The method of reducing a concentration of a gas of interest in the gun turret of claim 1, wherein said fan is caused to operate for a predetermined period of time.

6. The method of reducing a concentration of a gas of interest in the gun turret of claim 5, wherein said predetermined period of time is five minutes.

* * * * *